US012643697B2

(12) United States Patent
Schwaiger et al.

(10) Patent No.: US 12,643,697 B2
(45) Date of Patent: Jun. 2, 2026

(54) APPARATUS, ARRANGEMENT AND METHOD FOR PACKAGING LOADED GOODS WITH A PAPER WEB

(71) Applicant: Mondi AG, Vienna (AT)

(72) Inventors: Elisabeth Schwaiger, St. Stefan (AT); Paulus Goess, Klagenfurt (AT); Rudolf Estermann, St. Pölten (AT); Lars Göran Berglund, Sundsvall (SE)

(73) Assignee: Mondi AG, Vienna (AT)

( * ) Notice: Subject to any disclaimer, the term of this patent is extended or adjusted under 35 U.S.C. 154(b) by 85 days.

(21) Appl. No.: 18/686,498

(22) PCT Filed: Aug. 18, 2022

(86) PCT No.: PCT/AT2022/060288
§ 371 (c)(1),
(2) Date: Feb. 26, 2024

(87) PCT Pub. No.: WO2023/023682
PCT Pub. Date: Mar. 2, 2023

(65) Prior Publication Data

US 2025/0026512 A1 Jan. 23, 2025

(30) Foreign Application Priority Data

Aug. 25, 2021 (AT) ..... 50688/2021

(51) Int. Cl.
*B65B 11/04* (2006.01)
*B65B 41/16* (2006.01)
*B65B 45/00* (2006.01)

(52) U.S. Cl.
CPC ..... *B65B 11/045* (2013.01); *B65B 41/16* (2013.01); *B65B 45/00* (2013.01); *B65B 2210/20* (2013.01)

(58) Field of Classification Search
CPC ..... B65B 11/045; B65B 45/00; B65B 41/16; B65B 2210/18; B65B 2210/20; B25J 9/0096
See application file for complete search history.

(56) References Cited

U.S. PATENT DOCUMENTS 4,015,404 A * 4/1977 Anikanov ..... B65B 25/14 53/218
4,050,221 A * 9/1977 Lancaster, III ..... B65B 11/585 53/556

(Continued)

FOREIGN PATENT DOCUMENTS

EP 0467729 1/1992
EP 0533520 3/1993

(Continued)

OTHER PUBLICATIONS

Internationaler Recherchenbericht und Schriftlicher Bescheid [International Search Report and the Written Opinion] Dated Dec. 6, 2022 From the International Searching Authority Re. Application No. PCT/AT2022/060288 and Its Translation of Search Report Into English. (13 Pages).

*Primary Examiner* — Dariush Seif

(57) ABSTRACT

The invention relates to an apparatus, arrangement and method for packaging loaded goods (2) that are palleted or arranged on a pallet (1) by winding a paper web (3) around the goods helically whilst simultaneously unwinding the paper web (3) from a paper roll (4), comprising:—a rotary device (5) for rotating the pallet (1) and the loaded goods (2) located on the pallet (1) about a pallet rotational axis (6), —a roll holder (7) with at least one holding extension (8) for rotatably holding a paper roll (4) about a roll rotational axis (9), —an output device (10) for outputting the paper web (3) unrolled from the paper roll (4) in an output direction (11) pointing towards the rotary device (5) or the loaded goods (Continued)

(2), and—a lifting device (12) for changing the height (13) of the output of the paper web (3) from the output device (10), a pivoting device (14) with a pivoting carrier (16) pivotable about a pivot axis (15) being provided to tilt the output direction (11) of the paper web (3).

15 Claims, 4 Drawing Sheets

(56) References Cited

U.S. PATENT DOCUMENTS 4,235,062 A * 11/1980 Lancaster, III ..... B65B 11/045 53/399
4,409,777 A * 10/1983 White ..... B65B 11/045 53/214
4,432,185 A * 2/1984 Geisinger ..... B65B 11/006 53/138.2
4,458,467 A * 7/1984 Shulman ..... B65B 11/045 53/399
4,726,172 A * 2/1988 Widenback ..... B65B 11/045 53/399
4,807,427 A * 2/1989 Casteel ..... B65B 11/006 53/389.2
4,841,716 A * 6/1989 Roymberg ..... B65B 11/045 53/389.2
4,862,678 A * 9/1989 Humphrey ..... B65B 11/045 53/556
4,905,451 A * 3/1990 Jaconelli ..... B65D 65/22 53/410
4,995,224 A * 2/1991 Yourgalite ..... B65G 61/00 53/540
5,031,771 A * 7/1991 Lancaster ..... B65B 11/006 53/399
5,040,358 A * 8/1991 Thimon ..... B65H 23/32 53/556
5,040,359 A * 8/1991 Thimon ..... B65H 23/32 53/556
5,195,297 A * 3/1993 Lancaster ..... B65B 11/045 53/399
5,195,301 A * 3/1993 Martin-Cocher ..... B65B 11/045 53/465
5,216,871 A * 6/1993 Hannen ..... B65D 71/0096 53/399
5,226,269 A * 7/1993 Stoltenberg ..... B65B 39/04 53/436
5,307,609 A * 5/1994 Kurata ..... B29C 55/20 53/556
5,351,461 A * 10/1994 Fandard ..... B65B 11/585 53/157
5,430,995 A * 7/1995 Cere ..... B65B 11/045 53/375.9
5,447,008 A * 9/1995 Martin-Cocher ..... B65B 11/025 53/399
5,447,009 A * 9/1995 Oleksy ..... B65B 11/045 53/399
5,450,711 A * 9/1995 Martin-Cocher ..... B65B 11/025 53/556
5,463,842 A * 11/1995 Lancaster ..... B65H 20/34 53/399
5,772,369 A * 6/1998 Lerman ..... B65D 19/44 108/55.5
5,941,049 A * 8/1999 Lancaster, III ..... B65B 11/045 53/399
6,170,233 B1 * 1/2001 Marois ..... B65B 11/025 53/399
6,185,914 B1 * 2/2001 Mackie ..... B65B 11/045 53/556
6,195,961 B1 * 3/2001 Turfan ..... B65B 11/025 53/389.2
6,453,643 B1 * 9/2002 Buscherini ..... B65B 11/025 53/399
6,748,718 B2 * 6/2004 Lancaster, III ..... B65B 11/025 53/399
6,775,956 B1 * 8/2004 Lacey ..... B65B 11/585 53/399
7,114,308 B2 * 10/2006 Cox ..... B65B 11/045 53/64
7,178,317 B1 * 2/2007 Koskela ..... B65B 11/045 53/587
7,568,327 B2 * 8/2009 Lancaster, III ..... B65B 11/025 53/210
7,775,016 B2 * 8/2010 Cousins ..... B65B 11/045 53/556
8,001,745 B2 * 8/2011 Carter ..... B65B 57/02 53/64
8,695,312 B2 * 4/2014 Johnson ..... B65B 11/045 53/399
9,290,285 B2 * 3/2016 Johnson ..... B65B 11/00
10,358,245 B2 * 7/2019 Riemenschneider, III ..... B65B 59/003
10,392,143 B2 * 8/2019 Butturini ..... B65B 45/00
10,538,350 B2 * 1/2020 Lancaster, III ..... B65B 57/04
10,934,034 B2 * 3/2021 Lancaster, III ..... B65B 11/025
11,492,154 B2 * 11/2022 Laghi ..... B65B 41/16
11,643,229 B2 * 5/2023 Cousins ..... B65B 11/025 53/399
11,794,933 B2 * 10/2023 Lancaster, III ..... B65B 11/04
2002/0020145 A1 * 2/2002 Matsumoto ..... B65B 11/585 53/399
2002/0043053 A1 * 4/2002 Trottet ..... B65B 11/045 53/582
2002/0152726 A1 * 10/2002 Oguri ..... B65B 7/164 53/442
2005/0150811 A1 * 7/2005 Spencer ..... B65B 11/025 53/399
2007/0204565 A1 * 9/2007 Lancaster, III ..... B65B 11/025 53/399
2010/0025517 A1 * 2/2010 Cere ..... B65B 11/025 242/559.1
2010/0037562 A1 * 2/2010 Forni ..... B65B 51/00 53/461
2010/0083614 A1 4/2010 Lancaster, III et al.
2014/0208696 A1 * 7/2014 Phillips ..... B65B 41/12 53/461
2016/0122053 A1 * 5/2016 Zierden ..... B65B 41/16 53/556
2017/0203870 A1 * 7/2017 Mackie ..... B26F 1/08
2019/0337653 A1 11/2019 Butturini
2020/0239168 A1 * 7/2020 Sforacchi ..... B65B 61/22
2020/0407089 A1 * 12/2020 Jones ..... B65B 35/50
2021/0039815 A1 * 2/2021 Martin ..... B65B 11/025
2022/0169468 A1 * 6/2022 Cousins ..... B65H 23/1825
2022/0227513 A1 * 7/2022 Cere' ..... B65B 41/16
2025/0026512 A1 * 1/2025 Schwaiger ..... B65B 41/16
2025/0162742 A1 * 5/2025 Martin ..... B65B 57/04
2025/0178763 A1 * 6/2025 Martin ..... B65B 11/025

FOREIGN PATENT DOCUMENTS

| | | |
|---|---|---|
| EP | 1273519 | 1/2003 |
| EP | 3835220 | 6/2021 |
| EP | 4008638 | 6/2022 |
| IT | 102009901794735 | 6/2011 |
| WO | WO 2008/132566 | 11/2008 |
| WO | WO 2017/138893 | 8/2017 |

* cited by examiner

APPARATUS, ARRANGEMENT AND METHOD FOR PACKAGING LOADED GOODS WITH A PAPER WEB

RELATED APPLICATIONS

This application is a National Phase of PCT Patent Application No. PCT/AT2022/060288 having International filing date of Aug. 18, 2022, which claims the benefit of priority of Austria Patent Application No. A 50688/2021 filed on Aug. 25, 2021. The contents of the above applications are all incorporated by reference as if fully set forth herein in their entirety.

FIELD AND BACKGROUND OF THE INVENTION

The invention relates to an apparatus, an arrangement and a method according to the preambles of the independent claims.

Apparatuses for packing loaded goods that are palleted or arranged on a pallet are known and published in various embodiments.

For storing or transporting loaded goods, it is common to arrange the loaded goods on a pallet. Pallets such as flat pallets, transport pallets and Europool pallets are load bases with standardised dimensions or shapes. Loaded goods are loaded or palletised on such pallets. In order to protect the load from environmental influences or from falling off the pallet, the pallet and the loaded goods arranged on it are wrapped in a stretchable plastic film according to the state of the art and thus packaged.

There are two common designs for film wrapping machines. In a first embodiment, the pallet and the loaded goods arranged on it are set down motionless. For packaging, a roll of plastic film is now moved around the motionless, palletised loaded goods in order to unwind the film from the roll and wrap it around the loaded goods. In the other design, the plastic film roll is substantially stationary and the pallet is rotated on a turntable, whereby the film is pulled off the stationary roll and wrapped around the loaded goods.

The market now has a demand for packaging for palletised loaded goods that does not require plastic film.

As a replacement for the plastic film, the loaded goods can for example be wrapped in a paper web. These paper webs are usually rolled up into paper rolls to facilitate transport and handling.

However, these paper webs and paper rolls differ significantly from plastic film and film rolls, meaning that the plastic film in a conventional film wrapping machine cannot simply be replaced by a paper roll. For example, a suitable paper roll has an initial diameter of more than 0.5 m and a weight of more than 100 kg, optionally an initial diameter of about 80 cm and a weight of about 200 kg, in particular an initial diameter of up to 1.2 m and an initial weight of up to 500 kg, whereas conventional plastic film rolls have smaller diameters or dimensions and also only a fraction of the mass, for example 20 kg.

In particular in the high-performance sector, fully automatic wrapping machines must have a wrapping capacity of 60 pallets per hour or more. Due to the high mass of the paper rolls, the necessary wrapping speeds cannot be achieved with conventional film wrapping machines of the first design.

In addition, a paper web, even if a particularly stretchable paper is used, has a much lower stretchability than a plastic film. If the loaded goods are helically wrapped, creases may occur or the paper web may tear during feeding.

SUMMARY OF THE INVENTION

The object of the invention is now to create an apparatus, an arrangement and a method which overcomes the disadvantages of the prior art and, in particular, permits efficient helical wrapping of loaded goods with a paper web.

The object is in particular solved by the features of the independent claims.

The invention relates in particular to an apparatus for packaging loaded goods that are palleted or arranged on a pallet by helically wrapping a paper web around them while simultaneously unwinding the paper web from a paper roll.

Preferably, the apparatus comprises a rotary device for rotating the pallet and the loaded goods on the pallet about a pallet rotation axis.

Preferably, the apparatus comprises a roll holder with at least one holding extension for rotatably holding a paper roll about a roll rotational axis.

Preferably, the apparatus comprises an output device for outputting the paper web unwound from the paper roll in an output direction pointing towards the rotary device or the loaded goods.

Preferably, the apparatus comprises a lifting device for changing the height of the output of the paper web from the output device.

Preferably it is provided that a pivoting device with a pivoting carrier pivotable about a pivot axis is provided for tilting the output direction of the paper web.

Optionally, it is provided that the roll holder is mounted on the pivoting carrier and can be pivoted together with the pivoting carrier about the pivot axis.

Optionally, it is provided that the output device is mounted on the pivoting carrier and can be pivoted together with the pivoting carrier about the pivot axis.

Optionally, it is provided that the pivot axis extends substantially horizontally.

Optionally, it is provided that the pivot axis runs substantially through the common centre of gravity of all components that can be pivoted by the pivot device, wherein the components which can be pivoted by the pivoting device, are in particular at least the pivoting carrier, the roll holder, the output device and the paper roll.

Optionally, it is provided that the pivot axis substantially passes through a point at which the centre of gravity of the paper roll lies when it is held by the roll holder.

Optionally, it is provided that the pivoting device tilts the output direction to an output angle that substantially corresponds to the lead angle of the helical wrapping. Optionally, it is provided that this tilting is carried out automatically.

Optionally, a drive such as an electric actuator, a geared motor or a spindle drive is provided to tilt the output direction.

Optionally, it is provided that the pivoting device is engaged on the lifting device and can be raised and lowered by the lifting device.

Optionally, it is provided that the pivoting device has a loading position in which the roll rotation axis is aligned substantially horizontally in order to enable a standing paper roll to be put on horizontally the holding extension.

Optionally, it is provided that the pivoting device has at least one wrapping position during wrapping, in which the output direction runs obliquely in the direction of the rotary device or loaded goods when the lifting device changes the height of the output of the paper web from the output device.

Optionally, it is provided that the roll holder and the output device are mounted on the pivoting carrier.

Optionally, it is provided that an adjustment device for changing the distance between the roll holder and the output device is provided on the pivoting carrier.

Optionally, it is provided that the holding extension is arranged to be movable along the pivoting carrier relative to the output device.

Optionally, it is provided that the output device comprises a traction device for adjusting and/or keeping constant the traction of the paper web during wrapping.

Optionally is provided that the output device comprises a folding device for folding an edge of the paper web.

In particular, the invention relates to an arrangement, comprising:

an apparatus according to the invention, a paper roll held on or by the roll holder, and loaded goods palletised or arranged on a pallet, wherein the pallet is provided on the rotary device.

In particular, the invention relates to an method for packaging loaded goods that are palleted or arranged on a pallet by helically wrapping a paper web around them while simultaneously unwinding the paper web from a paper roll, comprising the following steps:

Rotation of the pallet and the loaded goods on the pallet about a pallet rotation axis, whereby the paper web is wrapped around the loaded goods and pulled off the paper roll by an output device, simultaneously changing the height of the output of the paper web from the output device by means of a lifting device, whereby the paper web is wrapped helically around the load.

Preferably, it is provided that the output direction of the paper web from the output device during the helical wrapping is tilted.

Preferably, it is provided that the output direction is tilted to an output angle that substantially corresponds to the lead angle of the helical wrapping. Preferably, it is provided that this tilting is carried out automatically.

The method is preferably carried out by or on an apparatus according to the invention and/or by or on an arrangement according to the invention.

The invention relates in particular to a wrapping machine, which enables the wrapping of loaded goods that are palleted or arranged on a pallet with a paper web. Preferably, the apparatus is a wrapping machine for semi-automatic and fully automatic applications, which enables, for example, a wrapping capacity of 5 to 60 pallets per hour, in particular of around 8 to 15 pallets per hour for semi-automatic applications and of around 30 to 60 pallets per hour for fully automatic applications. Preferably, the apparatus is configured to wrap palletised loaded goods with a maximum height of 2 m. Preferably, the apparatus is configured to package palletised loaded goods with a weight of up to 1200 kg.

Preferably, it is provided in all embodiments that the paper web is not pre-extended or pre-stretched in the output device, but that the paper web is extended and/or stretched during wrapping.

With a pallet height of around 110 cm and the use of 800×1200 mm Euro pallets, for example, around 10 to 14 $m^2$ of the paper web are used per pallet. For example, 0.5 to 1, in particular 0.6 to 1 kg of paper web is used per pallet.

Preferably, it is provided that the paper web consists of a recyclable paper. Preferably, it is provided that the paper web has a stretchability of more than 5%, in particular more than 8%, preferably more than 10%, and in particular from 10 to 12%. The paper itself optionally has an elasticity of 1 to 2%.

Optionally, a paper web is used that has one or more of the following parameters:

Grammage according to ISO 536:2019: 50-130 $g/m^2$

Strain according to ISO 1924-3:2005: MD 2-13%

Tearing resistance index according to ISO 1974:2012: MD min. 8 $mN*m^2/g$; CD min. 9 $mN*m^2/g$;

(MD: machine direction; CD: transverse direction)

Burst index according to ISO 2758:2014: min. 2 $kPa*m^2/g$

One example of a suitable paper for wrapping palletised loaded goods is paper with increased stretchability and increased tensile strength, in particular the product "Mondi Advantage StretchWrap".

Optionally, it is provided that the apparatus has a stationary, fixed machine frame. Preferably, it is provided that the paper roll, the roll holder, the output device, the lifting device, the pivoting device, the adjustment device, the traction device and/or the folding device are provided on the machine frame.

In particular, it is provided that the machine frame provides an adjustable lifting device that runs along the vertical axis. Preferably, it is provided that a pivoting carrier of the pivoting device is mounted on the lifting device, and the height of the pivoting carrier may be adjusted via the lifting device. Preferably, the pivoting carrier is coupled to the lifting device by the pivoting device so that it can pivot about a pivot axis. Preferably, the paper roll, the roll holder, the output device, the adjustment device, the traction device and/or the folding device are mounted on the pivoting carrier. Optionally, an adhesive application system for automatic operation, a paper web holding device and/or a paper web cutting device are mounted on the pivoting carrier. Preferably, all components mounted on the pivoting carrier may be pivoted about the pivot axis with the pivoting carrier.

Preferably, in all embodiments, the pivot axis extends in such a way that the output direction of the paper web can be tilted. Preferably, in all embodiments it is provided that the tilting in the vertical direction is enabled, i.e. that the output direction of the paper web may be tilted upwards and/or downwards. The pivot axis of the pivoting device preferably extends substantially horizontally and transversely to the pallet rotational axis.

Preferably, it is provided that the tilting may be selected such that the angle of the output direction corresponds to the angle at which the paper web is wrapped helically around the pallet or the loaded goods arranged thereon. In all embodiments, the angles are measured in particular relative to a horizontal line.

Preferably, in all embodiments, the paper web is output upright. In particular, this means that the paper web extends vertically from side edge to side edge.

Preferably, it is provided that the output direction may be adjusted and/or changed during wrapping. Preferably, it is provided that the output direction or the tilting is adjusted automatically.

Preferably, it is provided that that the paper web is stretched between the loaded goods and the output device during wrapping. Preferably, it is provided that the tractive force pulls the paper web off the paper roll. Preferably, it is provided that the tractive force actuates the pivoting device and/or tilts the pivoting carrier.

Preferably, it is provided that the pivot axis extends substantially through the common centre of gravity of all components that can be pivoted by the pivoting device, whereby the pivoting device is substantially balanced.

Preferably, it is provided that the pivot axis extends substantially through the centre of gravity of the paper roll, in particular through the intersection of the symmetry planes of the paper roll, or is supported on the centre of gravity. This means that the path of the pivot axis through the centre of gravity of the components is maintained, even if the mass of the paper roll changes as the paper web unwinds.

The fact that the pivot axis extends substantially through the centre of gravity means in particular that pivoting about the pivot axis is possible with relatively little effort. This means, for example, that the pivoting carrier and paper roll can be pivoted manually. Preferably, this means that the pivoting carrier can be automatically actuated by the tractive force or the tension of the paper web stretched between the loaded material and the output device.

Preferably, it is provided that the pivoting device has a loading position in which the roll rotation axis is substantially horizontal, so that a standing paper roll may be put on the holding extension. The paper roll is preferably fed via an infeed carriage. The axis about which the pivoting carrier is pivoted in order to bring the pivoting device into the loading position is preferably the same axis about which the pivoting carrier is pivoted in order to tilt the output direction during wrapping.

Optionally, a control unit is provided that controls and/or regulates one or more of the drives. For example, the control unit controls the rotary drive of the rotary device, the lifting drive of the lifting device and/or the drive of the tension control, whereby the drives can be coordinated or synchronised with each other by the control unit.

Optionally, the apparatus comprises one or more of the following components or systems:

a top press for weighing the load from above
a device for inserting a cover layer
a device for inserting edge protection angles
an adhesive application system
a paper web holding device
a paper web cutting device
a labelling system
a printer system
a conveyor device The invention relates in particular to a method for the wrapping of loaded goods that are palleted or arranged on a pallet with a paper web. Preferably, it is provided that the paper web is pulled off or unwound from the paper roll by actuating the rotary device, in particular by rotating the pallet and the loaded goods on the pallet.

Preferably, it is provided that the tension or tractive force acting on the paper web between the output device and the load is controlled and/or regulated. Optionally, it is provided that the paper web is decelerated or accelerated between the loaded goods and the paper roll, this change in speed being performed in particular by a tension control roller, optionally provided with a drive.

Optionally, it is provided that the outer circumference of the paper roll is pressed against the tension control roller, whereby this is done in particular by the adjusting device.

Preferably, it is provided that the loaded goods are helically wrapped by changing the height of the output paper web in addition to the output of the paper web by the output device. The helical wrapping has a certain lead angle. In order to achieve improved wrapping, the output direction of the paper web is preferably inclinable. Preferably, the output angle of the paper web can be changed and adjusted by a pivoting device. Preferably, the tilting of the paper web is changed and/or adjusted automatically. Preferably, the tilting of the paper web is adjusted by a tractive force or tension acting between the output device and the attachment of the paper web to the loaded goods, which actuates the pivoting device and, in particular, pivots the pivoting carrier about the pivot axis in such a way that the desired output angle is set. The optimal output angle or the inclination of the paper web depends, for example, on the relative movement of the output device and the rotary device or the loaded goods. In particular, the output direction depends on the speed at which the lifting device is actuated. In addition, the output direction also depends on how quickly the rotary device rotates the loaded goods and the pallet.

Preferably, it is provided that the paper web is folded over before or during output from the output device, whereby at least one edge, in particular the lower edge, is folded over and in particular folded over by 180°. Preferably, in all embodiments, the load goods are wrapped with a folded paper web. Optionally, the loaded goods are wrapped exclusively with a folded paper web.

Preferably, it is provided that the pivoting carrier is pivoted by 90° in order to bring the device, in particular the pivoting device, into its loading position.

Preferably, it is provided that the holding extension is a mandrel projecting from one side of the pivoting carrier. Preferably, the holding extension is rotatably mounted.

Preferably, it is provided that the output device always outputs the paper web at the same point irrespective of the unwinding of the paper web from the paper roll, whereby this point may be displaced by the lifting device so that the paper web may be output along a straight line by the output device and the lifting device. This straight line extends substantially vertically and in particular along the direction of movement of the lifting device.

For example, to prevent the paper from tearing in case of an underhang of the loaded goods on the pallet, the paper is preferably folded over in the lower part of the paper web. Due to the double layer, a high belt pull may be achieved, which is favourable for the stability of the loaded goods.

Optionally, it is provided that the paper is first deflected by 180° around a tension control roller. Optionally, it is provided that subsequently a 180° wrap is performed on a dancing roller, followed by a slight deflection of the paper web using a deflection roller. Optionally, it is provided that a cylindrical main folding roller is arranged downstream, which performs the first part of the fold in interaction with a conical folding roller. Using downstream rollers, the folding of the paper by 180° may be completed. The end is optionally formed by a support roller, which prevents the paper web from sinking.

Optionally, the tractive force in the paper web can be adjusted, controlled and/or regulated during the wrapping process.

For example, the first 2 to 3 layers are wound with a relatively low web tension, approx. 4 to 8 kg. The control unit may then increase the TARGET web tension either in stages or successively after a ramp; e.g. 10-20 kg for the upward wrapping and 20-30 kg for the last two top layers. For each of these preselected web tension values, it is advantageous if the value is constantly maintained. (target=ACTUAL). The optimum web tension profile depends on parameters such as the dimensions and shape of the loaded goods, position of the centre of gravity, weight of the individual piece goods, coefficient of friction between the piece goods and between the piece goods and pallet, wrapping pattern, web overlap, etc. and may be set for each individual case of application. The optimum web tension profile determined for one case of application is preferably stored as a programme in the control unit.

To control and/or adjust the tractive force, it may be provided that the paper roll is pressed against a tension control roller using the adjustment device, in particular a pneumatic cylinder. The tension control roller is for example controlled by a servomotor located directly on the tension control roller.

Optionally, a moment curve may be specified on the tension control roller as a result of the position of the rotary device and the associated effective radius, taking into account the inertia of the system. Optionally, the dancing roller is mounted on a linear guide with displacement measurement. This information may also be used for targeted control of the tractive force and/or the system.

BRIEF DESCRIPTION OF THE SEVERAL VIEWS OF THE DRAWINGS

The invention is further described below with reference to the figures.

DESCRIPTION OF SPECIFIC EMBODIMENTS OF THE INVENTION

Figure 1:
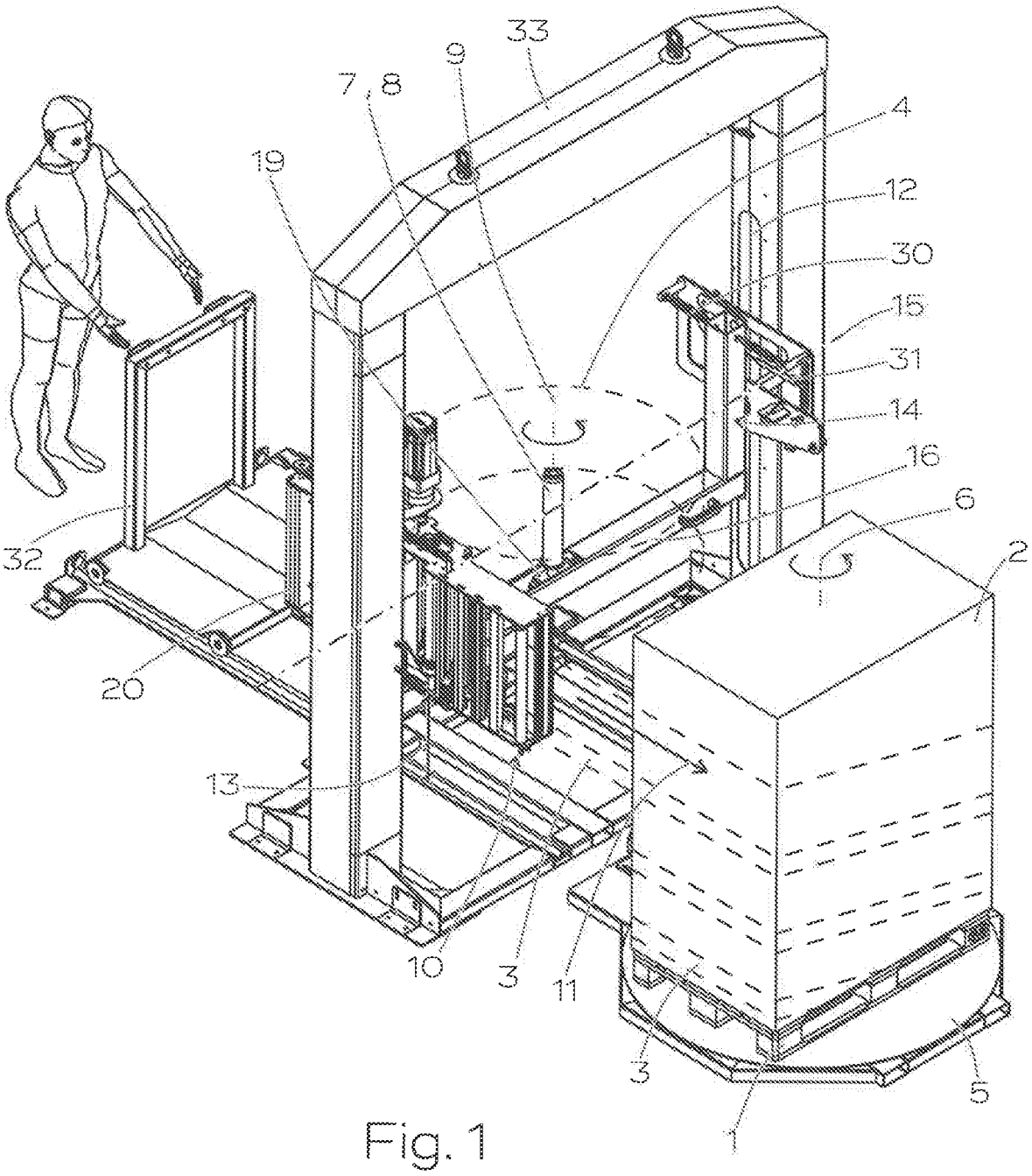
FIG. 1 shows a schematic oblique view of one embodiment of the apparatus.

Unless otherwise indicated, the reference numbers in the figures correspond to the following components: Pallet 1, loaded goods 2, paper web 3, paper roll 4, rotary device 5, pallet rotational axis 6, roll holder 7, holding extension 8, roll rotational axis 9, output device 10, output direction 11, lifting device 12, height (of the output of the paper web) 13, pivoting device 14, pivot axis 15, pivoting carrier 16, output angle 17, lead angle 18, adjustment device (for changing the distance between the holding device and the output device) 19, traction device 20, folding device 21, tension control roller 22, dancing roller 23, deflection roller 24, cylindrical main folding roller 25, conical folding roller 26, support roller 27, adjustment means (pneumatic cylinder) 28, drive (of the tension control roller) 29, spring 30, damper 31, infeed carriage 32, machine frame 33.

FIG. 1 shows a schematic oblique view of the apparatus. The apparatus comprises a rotary device 5. A pallet 1 is arranged on this rotary device 5, which may be rotated by the rotary device 5 about a pallet rotational axis 6. The loaded goods 2 are provided on pallet 1. These loaded goods 2 and in particular also the pallet 1 are to be wrapped with a paper web 3, whereby the paper web 3 is only shown in dashed lines in the present illustration in order to better represent the components of the apparatus. Preferably, the rotary device 5 has a rotary drive which is configured to rotate the pallet 1 and the loaded goods 2 arranged on it about the pallet rotation axis 6 and, in particular, to achieve a sufficient web tension.

A roll holder 7 is provided to hold the paper roll 4. The roll holder 7 comprises a holding extension 8. The roll holder 7 is suitable for rotatably mounting the paper roll 4. In particular, the paper roll 4 is mounted to rotate about a roll rotational axis 9. In all embodiments, it is preferably provided that the roll rotation axis 9 and the rotation axis of the paper roll 4 coincide. Due to the rotatable mounting of the paper roll 4, the paper web 3 may be unwound from the paper roll 4 by pulling the paper web 3 off.

The apparatus comprises an output device 10 for outputting the paper web 3 along an output direction 11. The output direction 11 is preferably directed towards the pallet 1 or towards the loaded goods 2.

In particular, it is provided that the pallet 1 and the loaded goods 2 arranged thereon are rotated by the rotary device 5, the paper web 3 being wrapped around the loaded goods 2 by the rotation of the loaded goods 2. The tractive force exerted by the rotation of the loaded goods 2 pulls the paper web 3 off the paper roll 4 through the output device 10.

A lifting device 12 is provided to helically wrap the loaded goods 2 along its entire height. It is configured to change the height 13 of the output paper web 3.

In order to be able to select the tilting of the output direction 11, a pivoting device 14 is provided. The pivoting device 14 comprises a pivoting carrier 16, which may be pivoted about a pivot axis 15.

The pivot axis 15 preferably extends transversely, in particular orthogonally to the roll rotational axis 9. The paper roll 4 is also not displayed in this illustration and is only shown schematically as a dashed line.

Preferably, the apparatus, in particular the output device 10, comprises a traction device 20 which enables the tractive force of the paper web 3 to be selected or regulated. Preferably, the pivoting carrier 16 has a degree of freedom of pivoting about the pivot axis 15, this degree of freedom being restricted in the present embodiment by the fact that at least one spring 30 and optionally also a damper 31 act on the pivoting carrier 16 in order to cushion and/or dampen its movement. In the present embodiment, two springs 30 engage on both sides of an element of the pivoting carrier 16 in order to resiliently restrict its movement on both sides. The further the pivoting carrier 1 6 is pivoted from its home position, the greater the counterforce exerted by the springs 30.

A damper 31 is provided to dampen oscillations. Preferably, a machine frame 33 is provided which supports some components of the apparatus.

In the present embodiment, an infeed carriage 32 is provided for feeding the paper roll 4.

When the paper web 3 is unwound from the paper roll 4, the diameter of the paper roll 4 changes. An adjustment device 19 is provided to compensate for the change in diameter. This adjustment device 19 may be used to adjust the distance between the holding extension 8 and the output device 10. In particular, the holding extension 8 of the roll holder 7 is displaceably arranged on the pivoting carrier 16 so that the distance between the holding extension 8 and the output device 10 may be selected. For this purpose, the adjusting device 1 9 may, for example, comprise a drive, whereby this drive may be an electric drive or a drive by means of a pretensioned spring. Preferably, the adjusting device 19 presses the paper roll 4 against a component of the output device 10.

Figure 2:
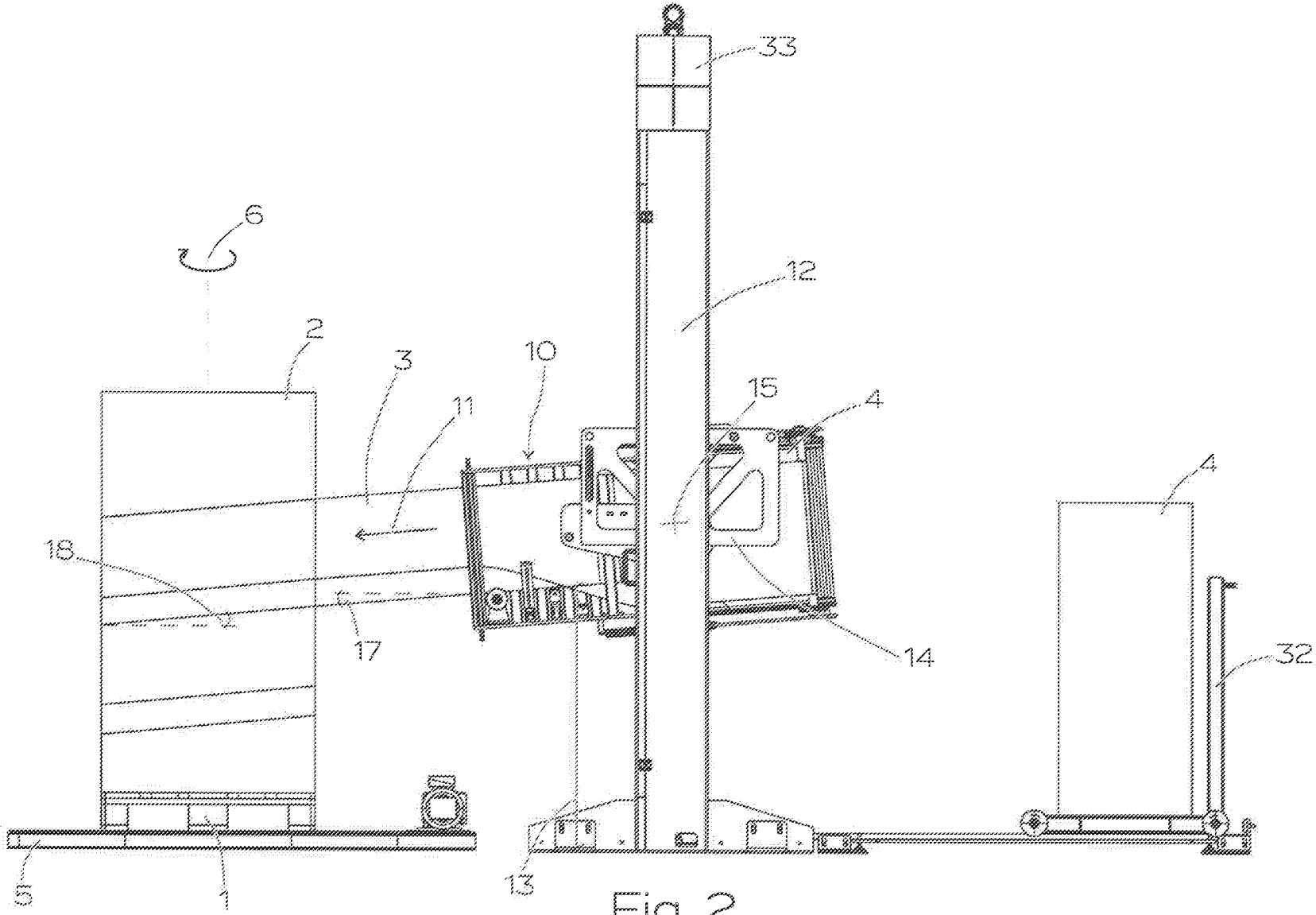
FIG. 2 shows a schematic side view of one embodiment of the apparatus.

FIG. 2 shows a schematic side view of an apparatus which may correspond in particular to the apparatus of FIG. 1. The apparatus, in particular the pivoting device 14, is in its wrapping position in the illustration of FIG. 2.

The loaded goods 2 are arranged on a pallet 1, which in turn is arranged on the rotary device 5. The rotary device 5 rotates the pallet 1 and the loaded goods 2 arranged on it around a pallet rotational axis 6. This rotary movement wraps a paper web 3 around the loaded goods 2. The paper web 3 is output along an output direction 11 by an output device 10. The paper web 3 is unwound from a paper roll 4 during outputting. Preferably, a lifting device 12 is actuated at the same time to change the height 13 of the output of the paper web 3. As a result, the loaded goods 2 can be helically wrapped in a helical shape. To prevent creasing of the paper during the helical wrapping or the paper web 3 from tearing during wrapping, a pivoting device 14 is provided. The pivoting device 14 allows the output direction 11 of the paper web 3 to be tilted. In particular, the output direction 11 is tilted by the output angle 17 in the present embodiment. The output angle 17 corresponds substantially to the lead angle 18 of the helical wrapping of the loaded goods 2. Preferably, the apparatus is configured to automatically set the output angle 17 by pulling the paper web 3 out of the output device 10 by the rotation of the loaded goods 2. As a result, depending on the actuation of the lifting device 12 and the rotary device 5, the output direction 11 may adjust automatically.

However, it is also entirely consistent with the idea of the invention to change the tilting or the output angle 17 by having a drive such as a rotary drive actuate the pivoting device 14.

Figure 3:
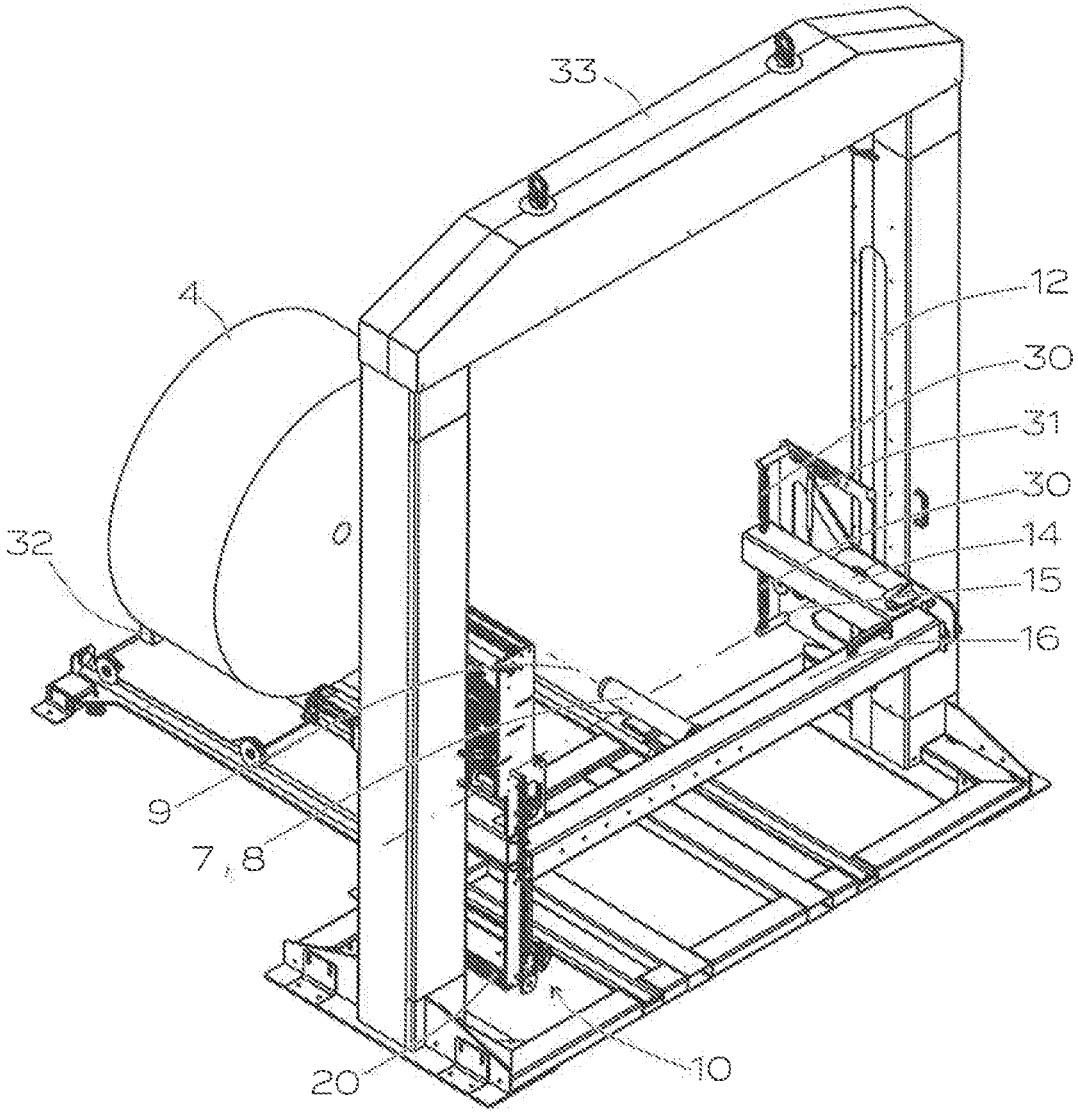
FIG. 3 shows a schematic oblique view of components of the apparatus in the loading position.

FIG. 3 shows a schematic oblique view of components of the apparatus in its loading position. The components correspond substantially to those shown and described in FIGS. 1 and 2.

In the loading position, the pivoting device 14 is in a position in which the holding extension 8 of the roll holder 7 is configured to be able to connect a paper roll 4 to the roll holder 7. In the present embodiment, the holding extension 8 extends substantially horizontally. Via the lifting device 12, the holding extension 8 is arranged at a height that substantially corresponds to the height at which the infeed of the paper roll 4 is arranged. This means that the paper roll 4 may simply be put on the holding extension 8 via the infeed carriage 32 shown in FIGS. 1 and 2.

In order to subsequently bring the apparatus into the wrapping position, the pivoting device 14 may be actuated so that the pivoting carrier 16 rotates about the pivot axis 15 until the holding extension 8 no longer extends horizontally but substantially from top to bottom.

Preferably, a new paper roll 4 can already be stored on the infeed carriage 32 while a further paper roll 4 is still arranged on the apparatus in order to wrap the loaded goods 2 with a paper web 3. Optionally, fixing bolts may be provided in all embodiments, which temporarily fix the pivoting device 14 in the loading position.

Figure 4:
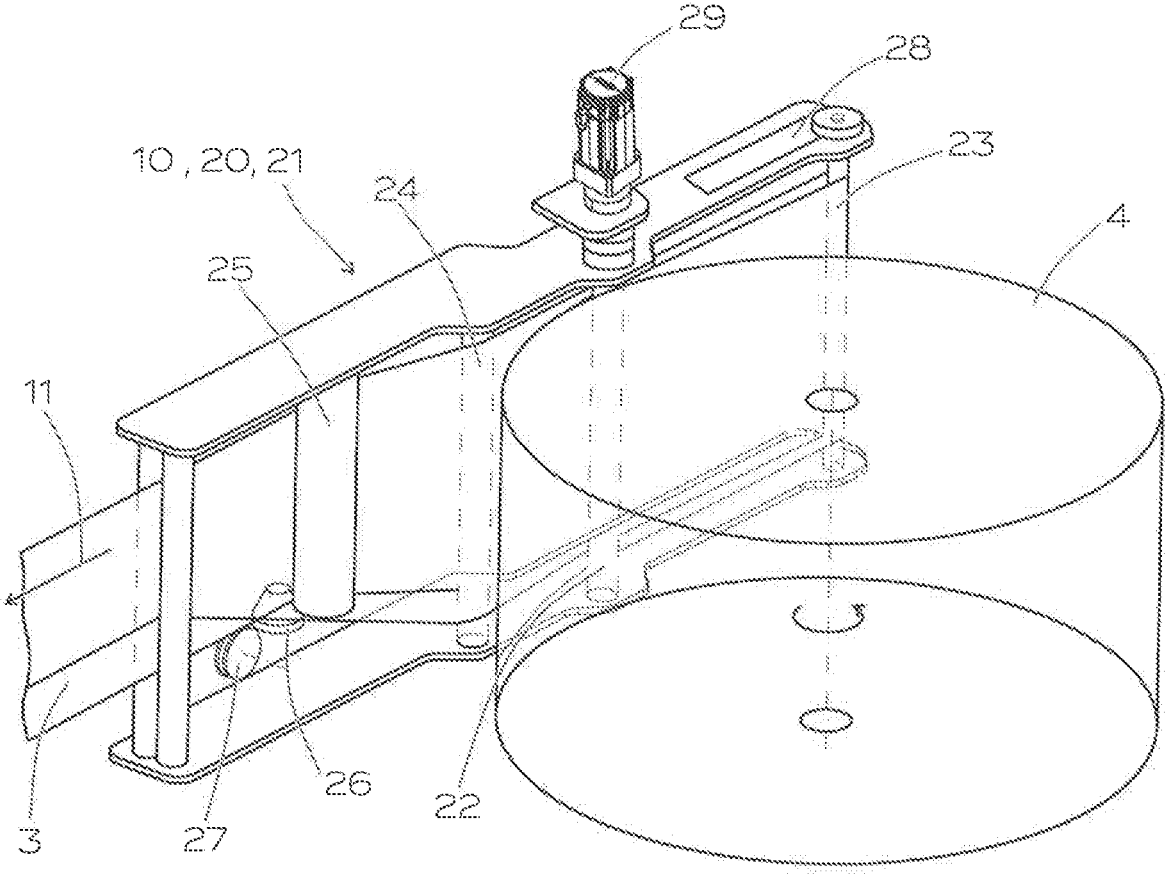
FIG. 4 shows a schematic oblique view of details of the apparatus.

FIG. 4 shows a schematic oblique view of details of a possible embodiment of an apparatus, whereby these details can also be provided in the embodiments of FIGS. 1, 2 and 3.

The embodiment shown in FIG. 4 comprises an output device 10 for outputting a paper web 3 along an output direction 11. The paper web 3 is unwound from the paper roll 4 and output along the output direction 11.

The embodiment shown in FIG. 4 comprises a folding device 21. This folding device 21 is configured to fold over at least one edge of the paper web 3 as it is output. This may improve the stability and/or tensile strength of the paper web 3. The folding device 21 comprises a cylindrical main folding roller 25 and a conical folding roller 26. When the paper web 3 is fed through, one edge of the paper web 3 is first pre-folded at an angle to the cooperation of the conical folding roller 26 and the cylindrical main folding roller 25 and then folded over by 180° so that one edge of the paper web 3 is folded over.

A support roller 27 can be provided downstream, which supports the paper web 3 from below, particularly at its unfolded edge, in order to prevent the paper web 3 from sinking. Two rollers arranged in pairs can be provided as further elements of the folding device 21 and/or the output device 10, which secure the folding and define a defined output location for the paper web 3.

Optionally, as in the present embodiment, the paper web 3 is deflected around a deflection roller 24 in order to ensure a constant winding angle of the paper web 3 onto the main folding roller 25.

The embodiment shown in FIG. 4 comprises a traction device 20. This tractive device 20 is configured to adjust or regulate the tension or tractive force acting between the loaded goods 2 and the output device 10. The traction device 20 comprises a tension control roller 22. This tension control roller 22 is arranged in the path of the paper web 3 immediately downstream of the paper roll 4 in order to brake or accelerate the paper web 3. In particular, the paper roll 4 is pressed against the tension control roller 22 via the adjustment device 19. A dancing roller 23 is provided along the path of the paper web 3 after the tension control roller 22. This dancing roller 23 is adjustably mounted, whereby an adjusting means 28 is provided which can adjust the position of the dancing roller 23. The tension of the paper web 3 can be adjusted by actuating this adjusting means 28, which is designed, for example, as a linear axis or as a linear operating actuator.

Preferably, it is provided that the paper web 3 is deflected around the dancing roller 23 and in particular deflected by 180°, so that the tractive force or the tension of the paper web 3 can be adjusted by actuating the adjusting means 28.

The tension control roller 22 preferably comprises a drive 29, via which the torque of the tension control roller 22 can be adjusted or selected.

The invention claimed is:

1. An apparatus for packaging loaded goods that are palleted or arranged on a pallet by helically wrapping a paper web around them while simultaneously unwinding the paper web from a paper roll, comprising:

a rotary device for rotating the pallet and the load goods on the pallet about a pallet rotational axis, a roll holder with at least one holding extension for rotatably holding a paper roll about a roll rotational axis, an output device for outputting the paper web unwound from the paper roll in an output direction pointing towards the rotary device or the loaded goods, a lifting device for changing the height of the output of the paper web from the output device, wherein a pivoting device having a pivoting carrier pivotable about a pivot axis for tilting the output direction of the paper web is provided, wherein the pivot axis runs substantially through the common centre of gravity of all components that can be pivoted by the pivot device, and/or that the pivot axis substantially passes through a point at which the centre of gravity of the paper roll lies when it is held by the roll holder.

2. The apparatus according to claim 1, wherein the roll holder is mounted on the pivoting carrier and can be pivoted together with the pivoting carrier about the pivot axis.

3. The apparatus according to claim 1, wherein the output device is mounted on the pivoting carrier and can be pivoted together with the pivoting carrier about the pivot axis.

4. The apparatus according to claim 1, wherein the pivot axis extends substantially horizontally.

5. The apparatus according to claim 1, wherein the components which can be pivoted by the pivoting device, are at least the pivoting carrier, the roll holder, the output device and the paper roll.

6. The apparatus according to claim 1, wherein the pivoting device inclines the output direction in an output angle which substantially corresponds to the lead angle of the helical wrapping, in particular that this tilting is carried out automatically.

7. The apparatus according to claim 1, wherein the pivoting device is engaged on the lifting device (12) and can be raised and lowered by the lifting device.

8. The apparatus according to claim 1, wherein the pivoting device has a loading position in which the roll rotation axis is aligned substantially horizontally in order to enable a standing paper roll to be put on horizontally on the holding extension.

9. The apparatus according to claim 1, wherein the pivoting device has at least one wrapping position during wrapping, in which the output direction runs obliquely in the direction of the rotary device or loaded goods when the lifting device changes the height of the output of the paper web from the output device.

10. The apparatus according to claim 1, wherein the roll holder and the output device are mounted on the pivoting carrier, that an adjusting device is provided on the pivoting carrier for changing the distance between the roll holder and the output device, in particular that the holding extension is arranged to be movable along the pivoting carrier relative to the output device.

11. The apparatus according to claim 1, wherein the output device comprises a traction device for adjusting and/or keeping constant the traction of the paper web during wrapping.

12. The apparatus according to claim 1, wherein the output device comprises a folding device for folding an edge of the paper web.

13. An arrangement, comprising:

an apparatus according to claim 1, a paper roll held on or by the roll holder, and loaded goods palletised or arranged on a pallet, wherein the pallet is provided on the rotary device.

14. A method of packaging loaded goods that are palleted or arranged on a pallet by helically wrapping a paper web around them while simultaneously unwinding the paper web from a paper roll, comprising the following steps:

Rotation of the pallet and of the loaded goods on the pallet about a pallet rotation axis, whereby the paper web is wrapped around the loaded goods and pulled off the paper roll by an output device, simultaneously changing the height of the output of the paper web from the output device by means of a lifting device, whereby the paper web is wrapped helically around the load, wherein the output direction of the paper web from the output device during the helical wrapping is tilted by a pivot device with a pivoting carrier pivotable around a pivot axis, wherein the pivot axis runs substantially through the common centre of gravity of all components that can be pivoted by the pivot device, and/or that the pivot axis substantially passes through a point at which the centre of gravity of the paper roll lies when it is held by the roll holder.

15. The method according to claim 14, characterized in that the output direction (11) is tilted to an output angle (17) which substantially corresponds to the lead angle (18) of the helical wrapping, in particular that this tilting is carried out automatically.

* * * * *